US007503276B1

(12) United States Patent
Curi et al.

(10) Patent No.: US 7,503,276 B1
(45) **Date of Patent: *Mar. 17, 2009**

(54) RETRACTABLE STEP WITH SECURE LOCKING MECHANISM

(76) Inventors: Suzanna Curi, 5580 Camino De Bryant, Yorba Linda, CA (US) 92887; Joseph A. Curi, II, 5580 Camino De Bryant, Yorba Linda, CA (US) 92887

( * ) Notice: Subject to any disclaimer, the term of this patent is extended or adjusted under 35 U.S.C. 154(b) by 0 days.

This patent is subject to a terminal disclaimer.

(21) Appl. No.: 11/982,029

(22) Filed: Oct. 31, 2007

Related U.S. Application Data

(60) Provisional application No. 60/998,484, filed on Oct. 10, 2007.

(51) Int. Cl.
*B63B 17/00* (2006.01)

(52) U.S. Cl. ..... 114/362

(58) Field of Classification Search ..... 114/362; 182/127; 280/166

See application file for complete search history.

(56) References Cited

U.S. PATENT DOCUMENTS 6,021,733 A * 2/2000 Jaramillo, Sr. ..... 114/362

7,314,019 B1 * 1/2008 Curi et al. ..... 114/362

* cited by examiner

*Primary Examiner*—Ed Swinehart
(74) *Attorney, Agent, or Firm*—Law Offices of David L. Hoffman

(57) ABSTRACT

A retractable U-shaped ladder assembly preferably for a craft such as a watercraft has a rotatably retractable ladder which is attached to the craft by brackets. A torsion spring is used to bias the ladder into its retracted position. While the ladder is in an in-use position, the ladder is locked into place against rotation by a locking mechanism. The locking mechanism includes a bent plate which presses against four rings that are fixed to a rod, which rod extends from each bracket. Each ring has a notch that is located in the same position. In the use position, the bent plate will fit into the notches of the rings and lock the step. When the user is finished using the ladder, the user can manually unlock the step by pressing the bent plate. The bent plate moves out of engagement with the notches in the rings, thereby allowing the torsion springs in the brackets to rotate the step to the retracted position. In another embodiment, the bent plate is formed as a U-shaped cover plate, and springs for retracting the ladder are positioned to the inside of the brackets. In a further embodiment, the cover plate is made of plastic and molded with two sleeves for pivotably mounting on pins. In addition, the rod is made of plastic and unitarily molded with the rings.

20 Claims, 15 Drawing Sheets

RETRACTABLE STEP WITH SECURE LOCKING MECHANISM

CROSS REFERENCE TO RELATED APPLICATION(S)

This application claims priority from U.S. patent application Ser. No. 11/407,767 filed Apr. 19, 2006, and from U.S. Provisional Patent Application No. 60/998,484, filed Oct. 10, 2007, entitled Retractable Step with Secure Locking Mechanism, both of which are incorporated by reference herein.

BACKGROUND OF THE INVENTION

1. Field of the Invention

The present invention relates to a boat or watercraft step with an improved support and retracting mechanism, and in particular, to such a step having a locking mechanism for locking the step in the retracted position.

2. Description of the Related Art

In watercraft such as personal watercraft and boats, it is desirable to have an outboard step, which assists a user in boarding a personal watercraft or boat, e.g., from the water after falling off, swimming or water skiing. In U.S. Pat. No. 5,970,905 to the present inventor, a retractable telescopic and rotatable step for a watercraft is disclosed. The patent teaches a U-shaped retractable step that retracts both rotationally and axially, and is mounted to the underside of the transom of a personal watercraft. The step is biased into the storage position by a relatively strong torsion spring. It would be desirable to lock the step in place when it is in the deployed (use) position.

U.S. Pat. No. 5,842,709 to Maccabee discloses a retractable swing down step assembly which is motorized and which locks into the storage position. The lock is meant to keep the step in place while the vehicle it is attached to is moving. The lock is actuated electronically. It does not have a locking mechanism that locks a step into the use position.

U.S. Pat. No. 4,312,515 to Allori discloses a self-locking step assembly for a vehicle. The step swings out of the retracted position and into the use position. In both positions the step locks due to a pin that fits into a slot on a cylinder. The cylinder rotates and the pin locks it into place. However, this lock requires the step to be in such a position where gravitational force causes the step to lock into place. This lock is also weak and insufficient for use on a boat ladder such as the one in U.S. Pat. No. 5,970,705 described above.

There is a need for a lock for a step for a retractable ladder for a personal watercraft or boat or other vehicle or structure, which lock is for the use position and which is easily released.

SUMMARY OF THE INVENTION

In one embodiment, the invention provides a locking mechanism for a U-shaped ladder having a rung and two parallel tubes or sides. The ladder is rotationally biased to in the storage position. The bias is created from a pair of torsion springs that are in each bracket. When put into the use position by the user the ladder automatically locks into place until it is manually unlocked by the user. The locking mechanism prevents injury to the user when he or she is getting off the ladder because it prevents it from snapping back until the user is ready for it to retract.

In a preferred embodiment the locking mechanism includes a rod, a bent plate preferably made of plastic and rings or washers which form a cam surface. The rings or washers are fixed to the rod and in another embodiment, the rings preferably are unitary therewith and preferably both are made of plastic. The rod extends between the brackets of the ladder which are used to mount the ladder to the underside of the boat. The rod is rotationally biased by large springs in the same direction as the ladder because the rod is rotating with the ladder. The large springs are preferably mounted around each end of the rod, in this alternative preferred embodiment, whether the rod and rings are plastic or metal, and whether unitary or not.

The bent plate is on an axis that is formed by two short rods or pins. The bent plate is rotatable in a teeter-totter fashion on the axis. Another smaller torsion spring (or springs) biases the bent plate in the opposite rotational direction as the ladder. When the ladder is in the storage position, the bent plate rests against the rings. In another variation, the bent plate may be made in a U-shaped section, and may also be plastic or metal.

Each of the rings has a notch that is located in the same circumferential position. When the ladder is put into the use position, the bent plate is urged into the notches preventing retraction of the ladder. The lock may then be manually unlocked by the user when he or she is in a safe position to do so.

To unlock the ladder the user simply has to push on the top of the bent plate, rotating it against the bias of the smaller torsion spring (or springs) so that the bottom of the bent plate is lifted out of the notches and the ladder is free to rotate back into the storage position.

DESCRIPTION OF THE PREFERRED EMBODIMENT(S)

Figure 1:
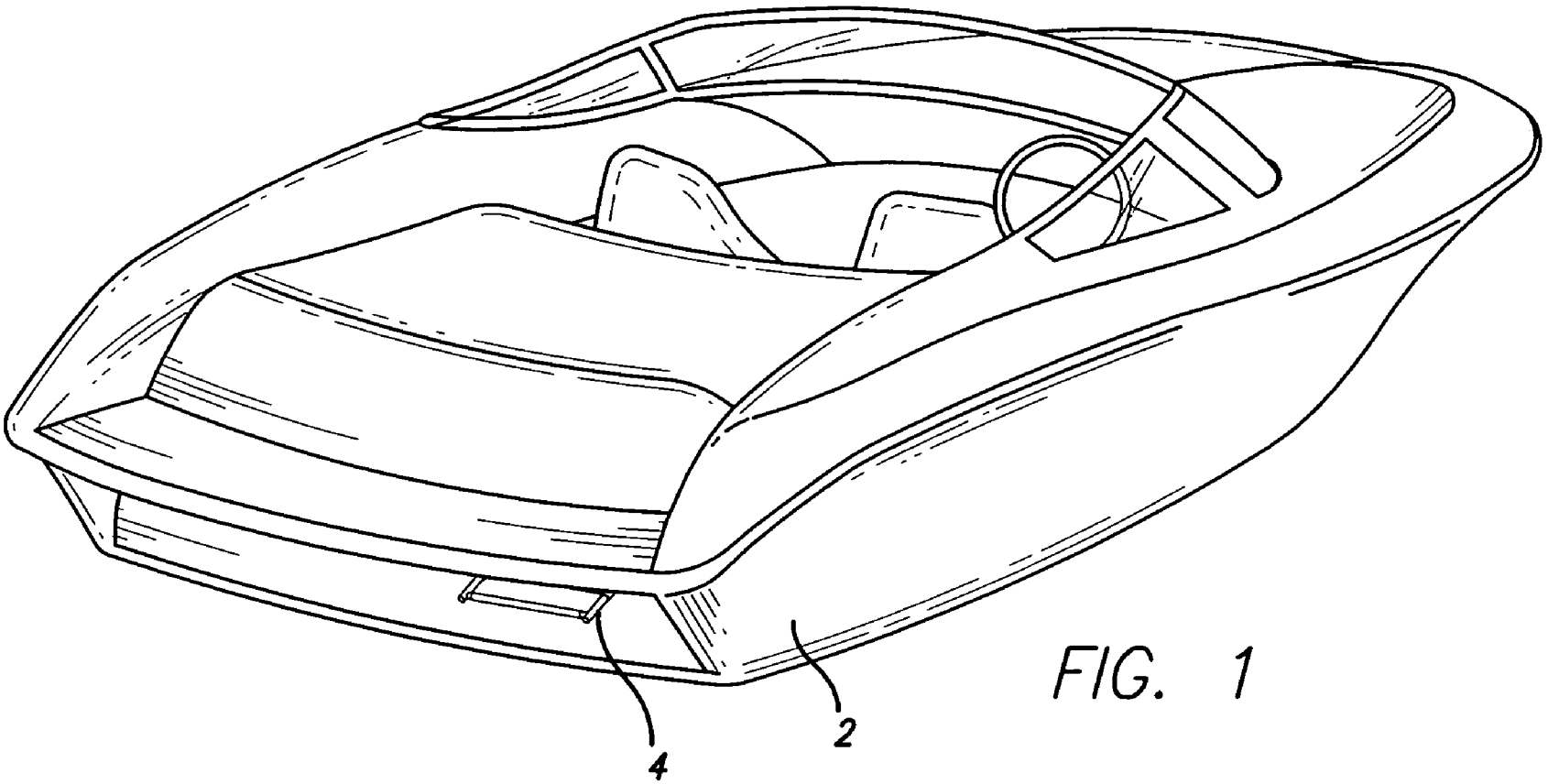
FIG. 1 is a perspective ladder assembly mounted to the underside of a boat and having a locking mechanism in accordance with a first embodiment of the invention.

In FIG. 1 a ladder assembly 4 in accordance with a first preferred embodiment of the invention is mounted to the underside of a rear platform of a boat or personal watercraft 2. The ladder assembly includes a ladder 9, which is shown in the retracted position in FIG. 2. Ladder 9 is mounted by two bracket members 8 to underside 12 of the boat's rear platform. Each bracket member 8 includes two flanges 14 fixed by bolts 16 to the boat. The flanges extend in between two side walls 17 of each bracket member 8.

The ladder 9 includes a first or base ladder having two parallel base tubes 22 joined by a rung 13. The invention may be embodied in a single rung ladder, but also may be embodied as shown in a multi-rung ladder having a telescoping second ladder member with two parallel telescoping tubes 23. The tubes 23 telescope within the base tubes 22, and a rung 11 connecting the two telescoping tubes 23. Such a structure is well known in the art. It is also possible to have even more rungs.

Figure 8:
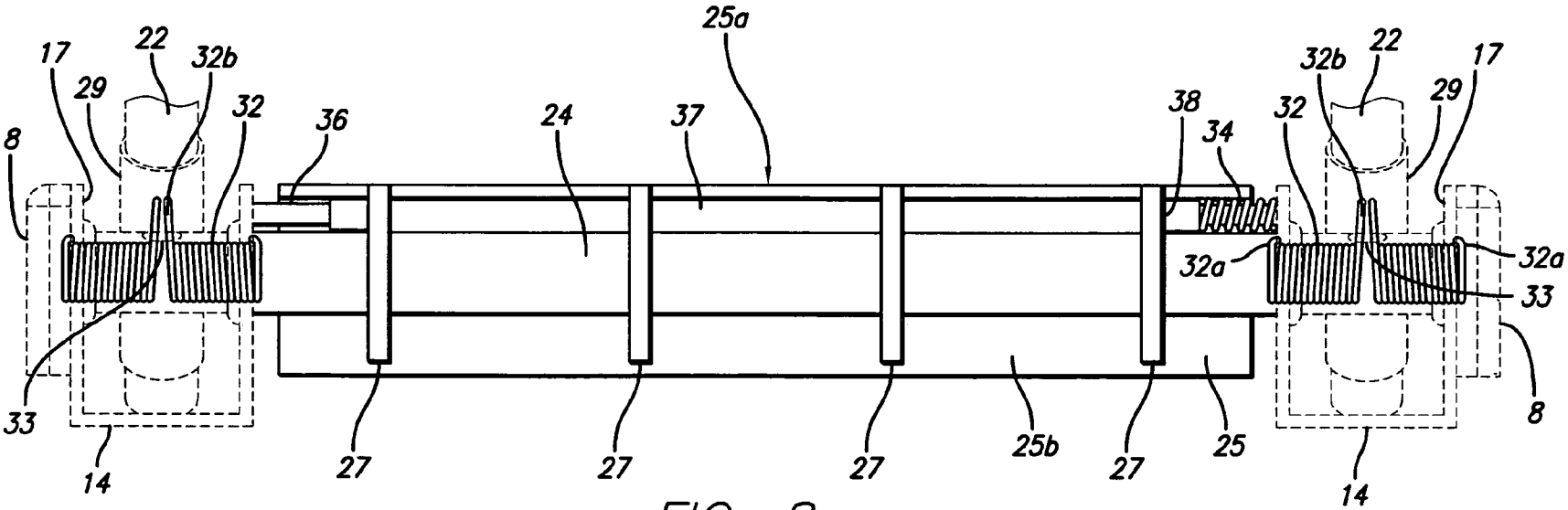
FIG. 8 is a bottom view of a cross member extending from one bracket to another.

As shown in FIG. 8, ladder assembly 4 includes two brackets members 8 having a cross member 24 extending therebetween. Each bracket member further includes a spring assembly 32 biasing the ladder to its storage position (to rotate up toward the bottom of the rear platform of the boat). Spring assembly 32 includes one or two torsion springs. An advantage of two springs is that more torque may be obtained. One end 32*a* of each spring 32 connects to one side wall 17 of each bracket 8, e.g. by fitting into a slot. An opposite end 32*b* of each spring 32 connects to the cross member 24, e.g. by fitting into a slot 33 in the cross member 24.

Figure 6:
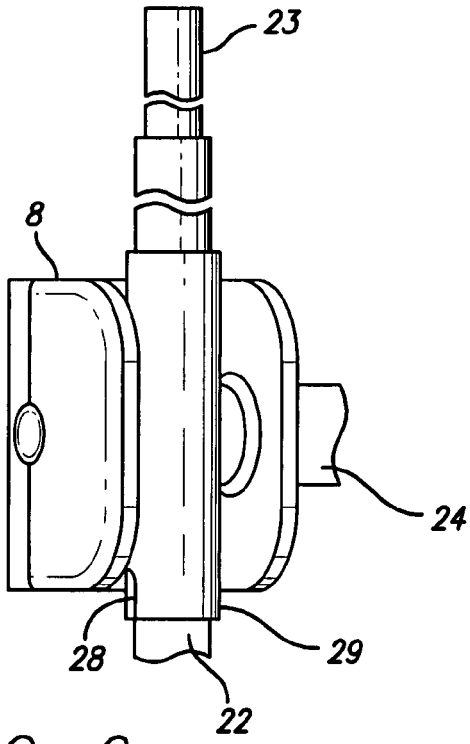
FIG. 6 is a perspective view of one of the brackets with the connected cylindrical sleeve having telescoping tubes.
Figure 7:
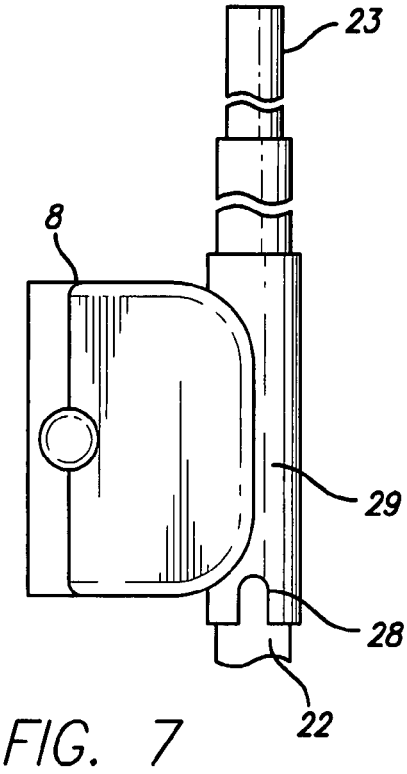
FIG. 7 is a side view of the same structure as in FIG. 6.

As shown in FIGS. 6 and 7, in between each bracket 8, a cylindrical support 29 is welded to the cross member 24. Each support 29 supports one parallel tube 22. The tubes 22 slide through the supports 29 freely until being stopped at one end by pins 30 in the intermediate position (see FIG. 3 solid position) or on the other end by the first rung 13 in the storage position (see FIG. 2). In the rear of the supports 29, which are fixed, e.g. by welding, to the cross member 24, there is a cut-out 28. Cut-out 28 slidably receives the pin or rod 30 when the tubes 22 are pulled through or extended through supports 29.

Figure 2:
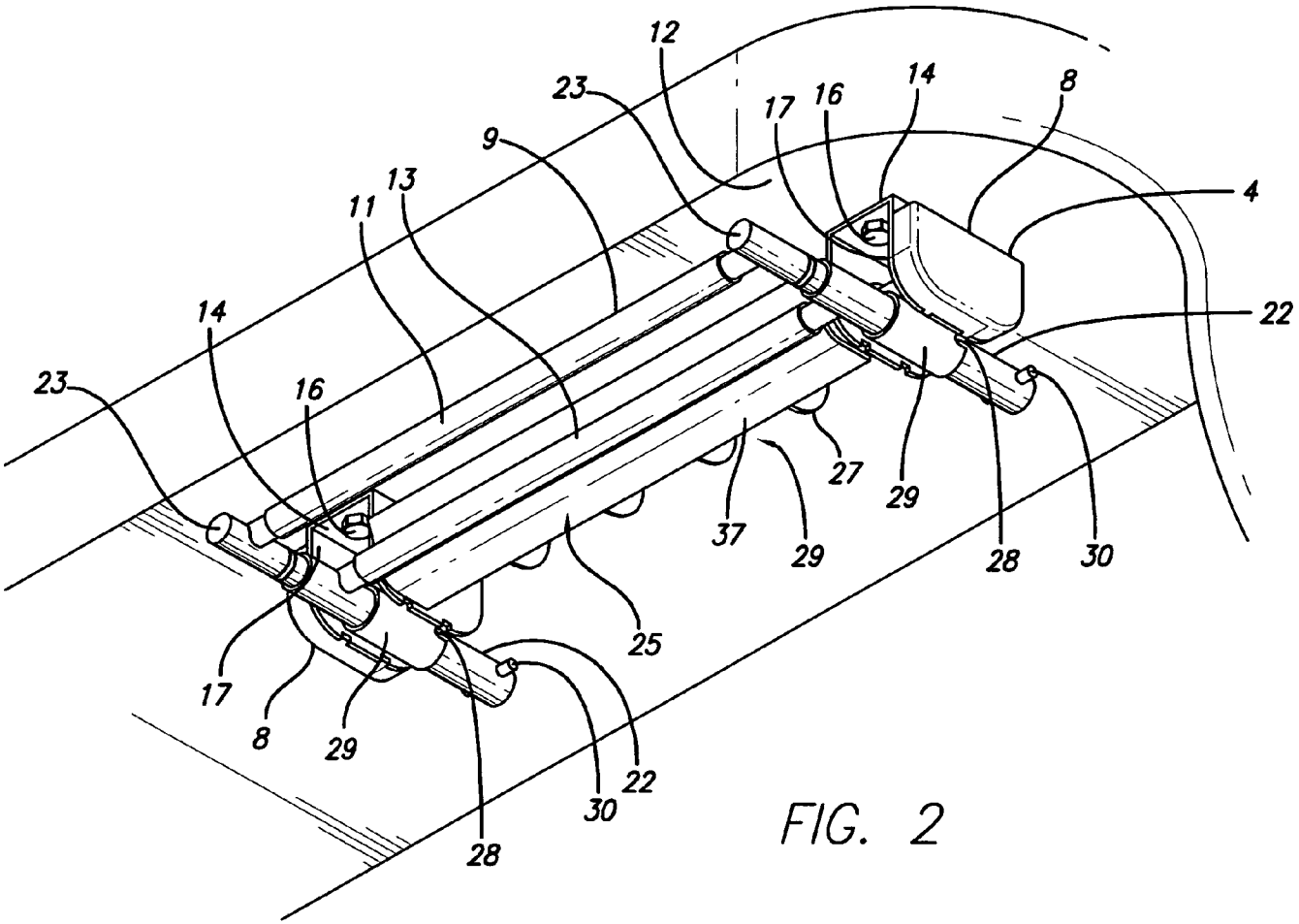
FIG. 2 is an enlarged perspective view of the ladder of FIG. 1.

With continued reference to FIGS. 2 and 3, operation of the step will now be described. In the retracted (storage) position as shown in FIG. 2, the ladder is either level or at an angle, e.g., a shallow angle of approximately six or ten degrees. It is held up sufficiently by the strength of the torsion springs. While there may be some play, generally this is not of concern. If it is, additional support could be provided such as a strap connected to the stern of the boat or a spring clip catch fastened to the stern, or other structure as would be evident to one of ordinary skill in the art.

To use the ladder a person on the boat leans over the stern and pulls the ladder outward. If it is a two-rung ladder, this person pulls out at least the base rung and may pull out both rungs. This same procedure may be followed by someone in the water who wants to get onto the boat. The ladder will then be in an intermediate position as shown in FIG. 3. The person in the water or on the boat then presses down on the ladder or pulls the ladder down rotating the ladder through an angle A (usually about 90°) against the bias of the torsion spring 32. The ladder can now be used to enter or exit the boat. The ladder is in the position ("use position") shown in phantom in FIG. 3.

In order to prevent injury to the user, especially a person exiting the boat 2 or personal watercraft, a preferred embodiment of the present invention includes a locking assembly 37 to lock the ladder into the use position until actuated by the user. Such a locking assembly is shown in FIG. 8.

Welded to the cross member 24 are washers 27 or rings. Preferably, there are four evenly spaced washers 27. Also extending in between each bracket is a plate 25 which is preferably a bent plate. Because cross member 24 is fixed to supports 29 and thus is fixed to ladder 9, cross member 24 is rotated by the torsion spring 32 in the same direction as the ladder 9, which is biased into the storage position.

Figure 4:
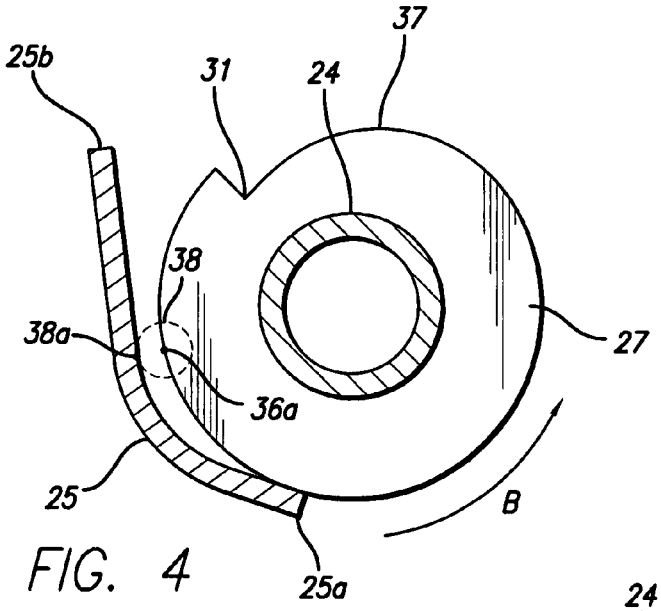
FIG. 4 is an enlarged sectional view showing one end of a bent plate of the locking mechanism resting against a washer when the ladder is in a storage position.
Figure 4A:
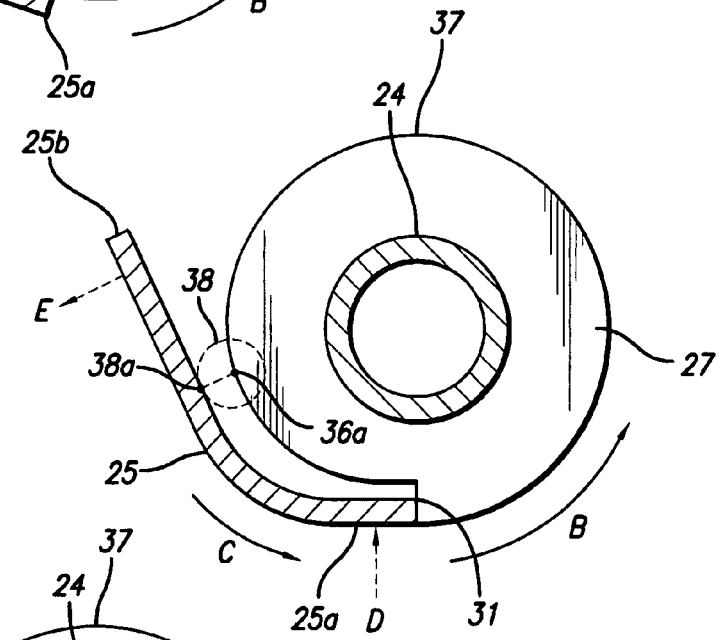
FIG. 4A is an enlarged sectional view similar to FIG. 4 but showing the locking mechanism in the locked position with the end of the bent plate fitting into a notch of the washer.
Figure 5:
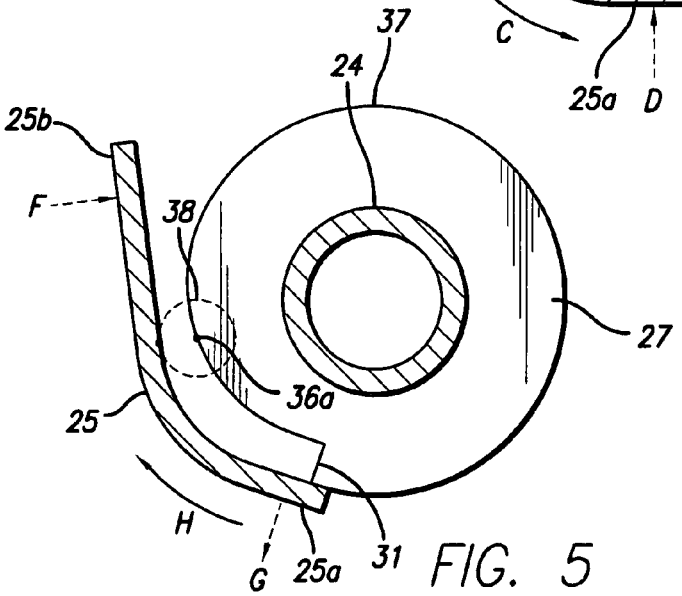
FIG. 5 is an enlarged sectional view similar to FIG. 4 but showing the locking mechanism in an actuated position with the one end being just above the notch of the washer.

Each washer 27 has a notch 31 in the same circumferential position, as best shown in FIGS. 4, 4A and 5. The notch 31 is preferably at an angle that is slightly smaller than 90° with the washer's circumference to form a tooth or gripping mechanism. The lock assembly further includes bent plate 25 which is rotatable around an axis formed by two small rods 36 (or one long rod) that extend from each bracket and end just before the first washer on its respective side. The bent plate 25 is fixed to, e.g. by welding, two cylindrical sleeves 38 which wrap around rods 36. This allows the bent plate 25 to rotate about the axis 36*a* formed by rods 36.

There is also a torsion spring 34 which biases bent plate 25 in a counterclockwise direction shown by arrow C in FIG. 4A. One end 34*a* of spring 34 is fixed, e.g. welded, to bent plate 25 or fixed to a sleeve 38, and the other end 34*b* fits into a side wall 17 of bracket 8. The bias of spring 34 causes the bottom 25*a* of bent plate 25 to press against the washers 27. In the storage position shown in FIG. 4, end 25*a* of the bent plate 25 rests against the washers 27 locking the rod 24 from rotating, thereby locking the ladder from rotating.

When the user rotates ladder 9 counterclockwise (arrow B in FIG. 4) about 90° or a little more than 90° so that the ladder is slightly past the use position, notch 31 will be slightly past end 25*a* of bent plate 25. Bent plate 25 will now rotate in the direction of arrow C. End 25*b* rotates in the direction of arrow E and end 25*a* will move in the direction opposite to arrow D to engage the notch 31, thereby locking the ladder in place. Specifically, when the step is released by the user, the ladder 9 will slightly rotate towards the retracted position (clockwise) until the bottom 25*a* of the bent plate 25 is pressed against the notches 31 of the washers 27. The ladder 9 is now locked into the use position so that the user can safely use the ladder to enter or exit the boat 2 or personal watercraft.

To release the locking assembly, the user pushes against the top of the bent plate 25 in the direction shown by arrow F in FIG. 5. This causes the opposite end 25*a* to move in the direction of arrow G and bent plate 25 to rotate along the axis 36 in a clockwise direction (shown by arrow H) against the spring bias so that the bottom 25*a* of the bent plate 25 radially clears notches 31 of washers 27. The user can then release ladder 9 and allow it to rotate back into the intermediate position as shown in FIG. 3. In the intermediate position, ladder 9 is preferably above horizontal by a sufficient amount that gravity will retract or assist in retracting tubes 23 into base tubes 22 and base tubes 22 will retract too into the position of FIG. 2. The user may assist in this retraction.

A variation of the positioning of the ladder is described in U.S. Pat. No. 5,970,905, incorporated by reference herein which variation could also be adapted to include the present locking mechanism. Other variations in position and use are possible, as would be evident to one of ordinary skill in the art.

Figure 9:
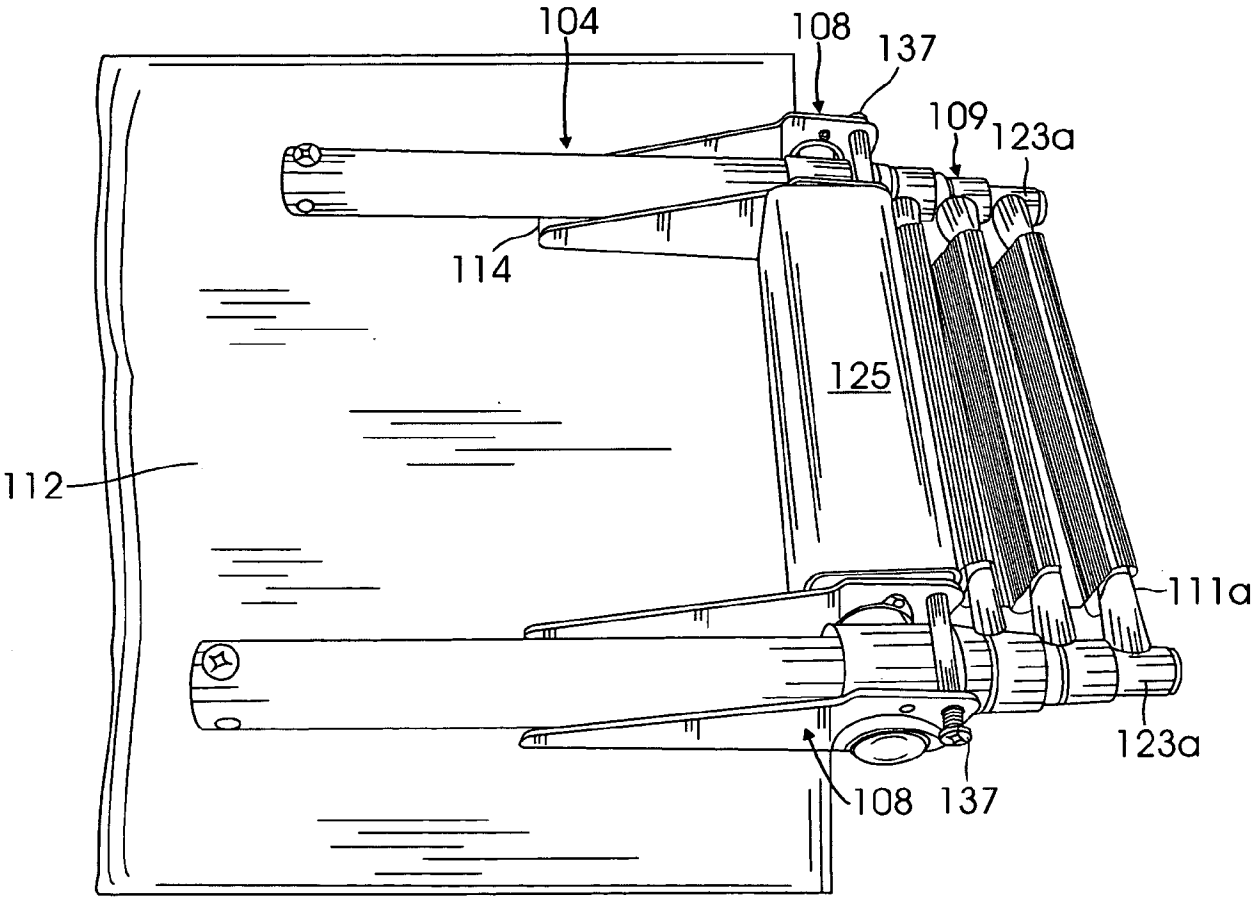
FIG. 9 is a top perspective view of a ladder with a locking mechanism in accordance with a second embodiment of the invention.

In a second preferred embodiment, a retractable ladder assembly 104 includes a ladder 109, shown in a retracted position in FIG. 9. Ladder 109 is mounted by two bracket members 108 to a top surface 112 of the boat's rear platform. (Alternatively, the ladder assembly of FIG. 9 may be mounted to an underside of the boat's rear platform, and note that the ladder assembly 4 of FIG. 2 may be mounted to a top surface of the boat's rear platform.)

Figure 10A:
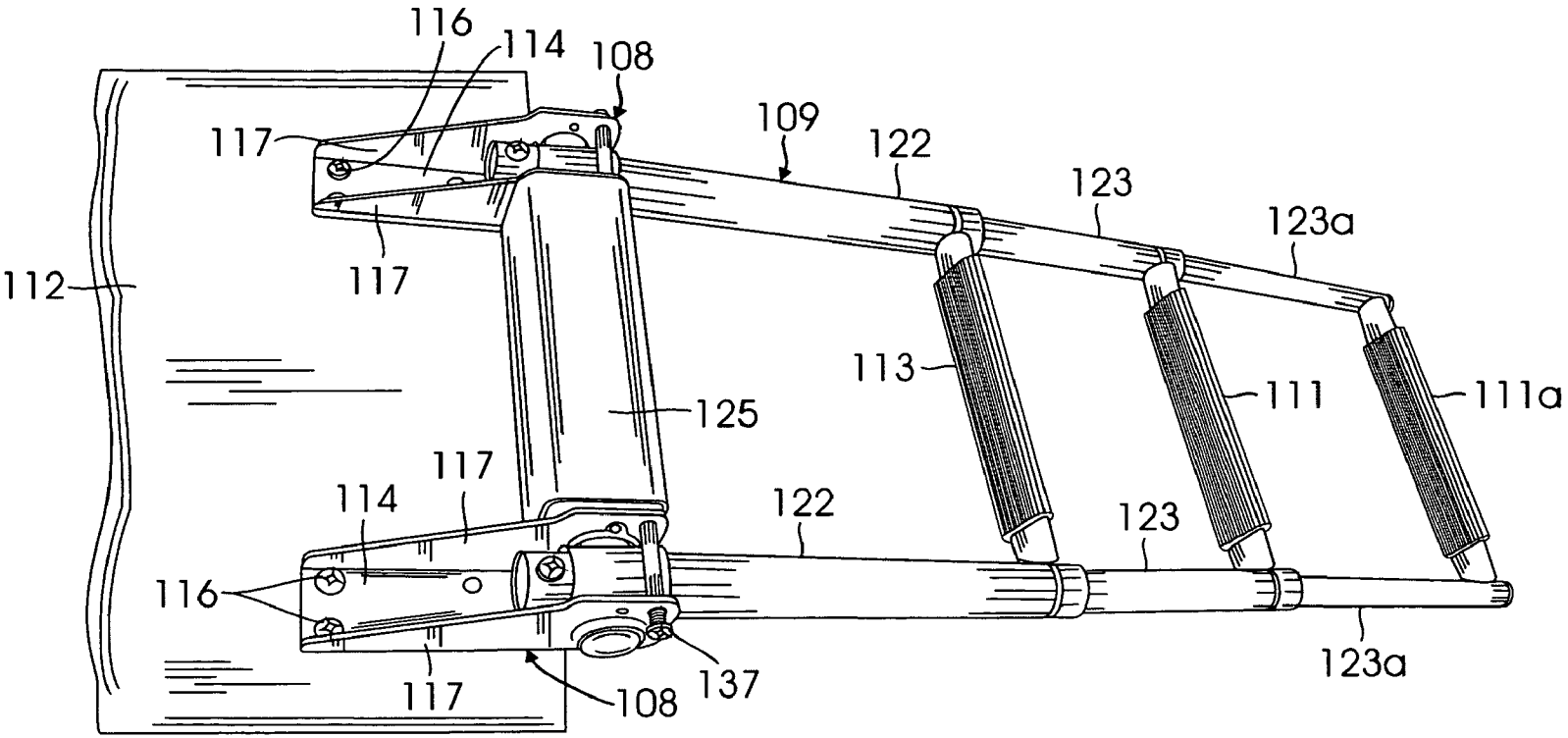
FIGS. 10A and 10B are views similar to FIG. 9 showing the ladder in an extended intermediate position and in an in-use position, respectively.

Each bracket member 108 includes two flanges 114 fixed by bolts 116 to the boat as shown in FIG. 10A. The flanges extend in between two side walls 117 of each bracket member 108.

The ladder 109 includes a first or base ladder having two parallel tubes 122 joined by a rung 113. The invention may be embodied in a single rung, or a multi-rung ladder having a telescoping second ladder member (and in this embodiment, a telescoping third ladder member) with two parallel telescoping tubes 123. The tubes 123 telescope within the base tubes 122, and a rung 111 connecting the two telescoping tubes 123. Additional telescoping tubes 123*a* are shown in FIGS. 9 and 1 OA with a total of three rungs including third rung 111*a*. Such a structure is well known in the art. It is also possible to have even more rungs.

Figure 10B:
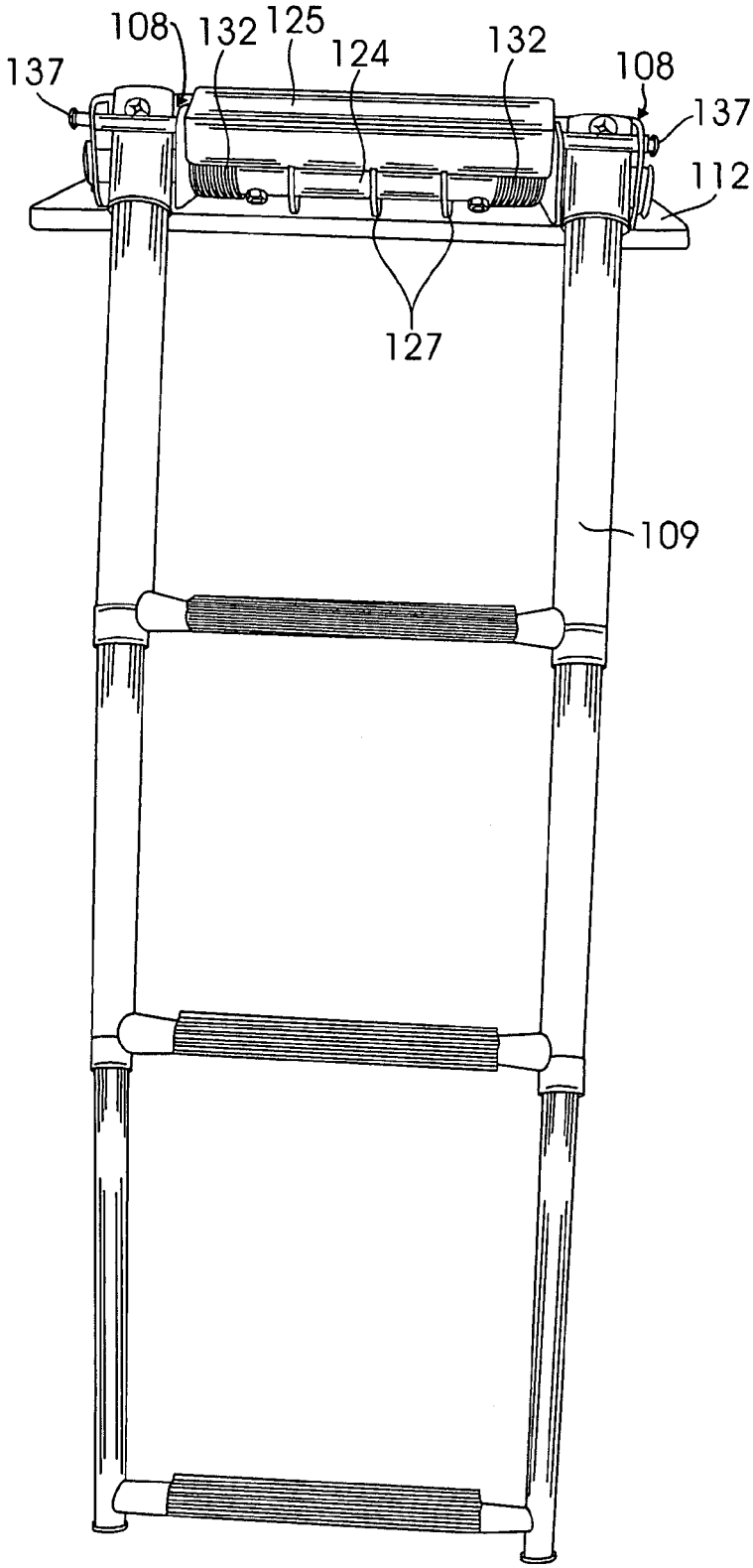

As shown in FIG. 10B, ladder assembly 104 includes the two bracket members 108 and has a rod or cross member 124 extending there between. Each bracket member 108 further has adjacent thereto a spring assembly 132 (preferably of relatively large torsion springs) biasing the ladder to its storage position (to rotate up toward the top surface of the rear platform of the boat). Each spring assembly preferably is one spring 132 which is positioned outside the bracket member 108 unlike the embodiment shown in FIG. 8 where the springs 32 are inside the brackets, so that the spring 132 can be made substantially larger in length and thickness, as compared with the springs 32 of the first embodiment. Each larger spring 132 can provide as much force if not more than the two springs of the first embodiment, by virtue of spring constant $K_2$ being significantly larger and a length $L_2$ of the spring 132 being chosen so that $K_2$ times $L_2$ is larger than $K_1 x L_1$ of the first embodiment's springs 32, or at least about the same.

Figure 13:
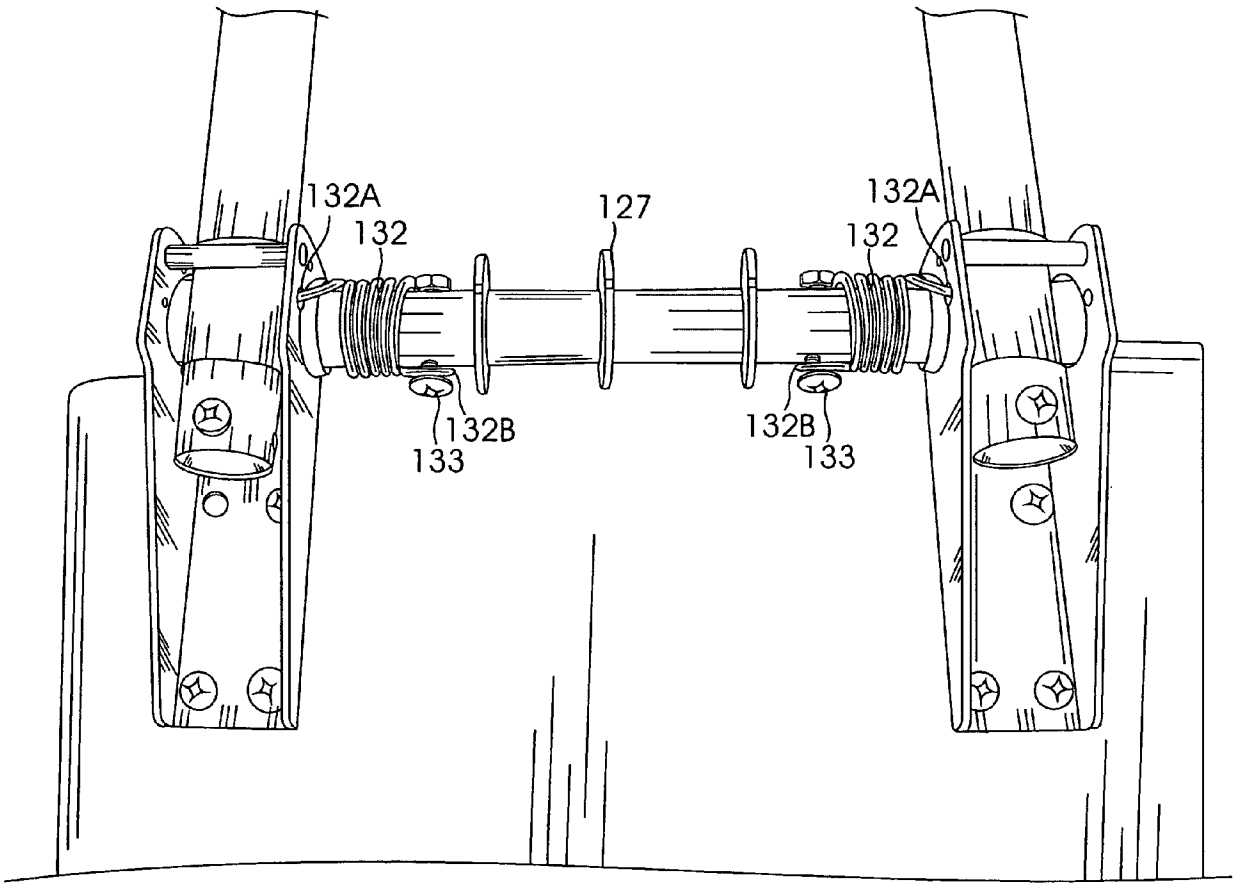
FIG. 13 is a view of the locking mechanism of FIG. 9 showing a rod or cross member extending from one bracket to another and showing attachment of large springs.

As shown in FIG. 13, one end 132A of each spring 132 connects to one side wall 117 of each bracket 108, e.g., by fitting into a slot or hole. An opposite end 132B of each spring 132 connects to cross member 124, e.g., by fitting around or against screws 133 in the cross member 124. In the plastic version shown by FIG. 17, rod 224 may have slots 233 for receiving one end of the torsion spring but screws could also be used to hold the end of the springs.

Figure 11:
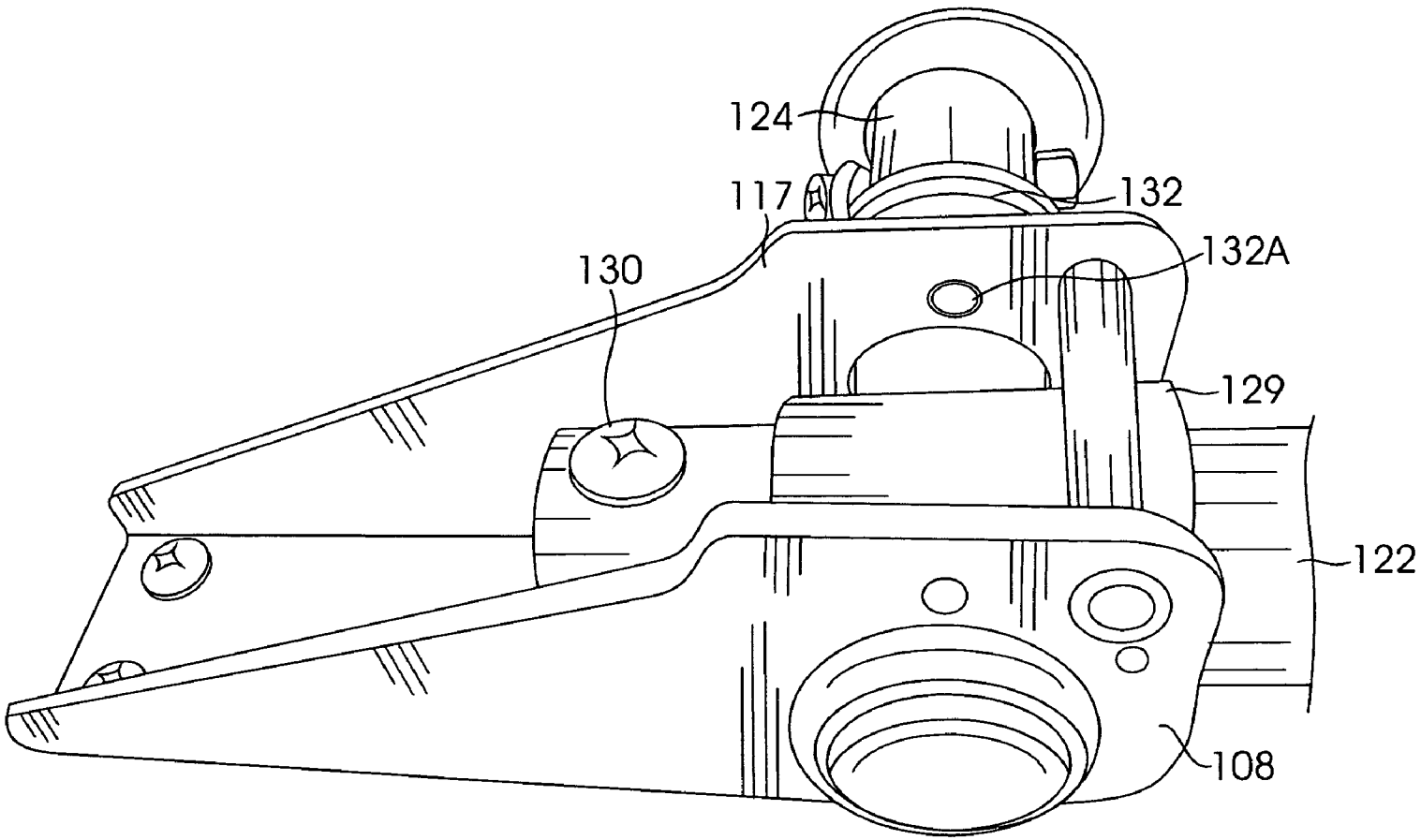
FIG. 11 is a perspective view of one of the brackets of FIG. 9 with the connected cylindrical sleeve having one or more telescoping tubes.
Figure 12:
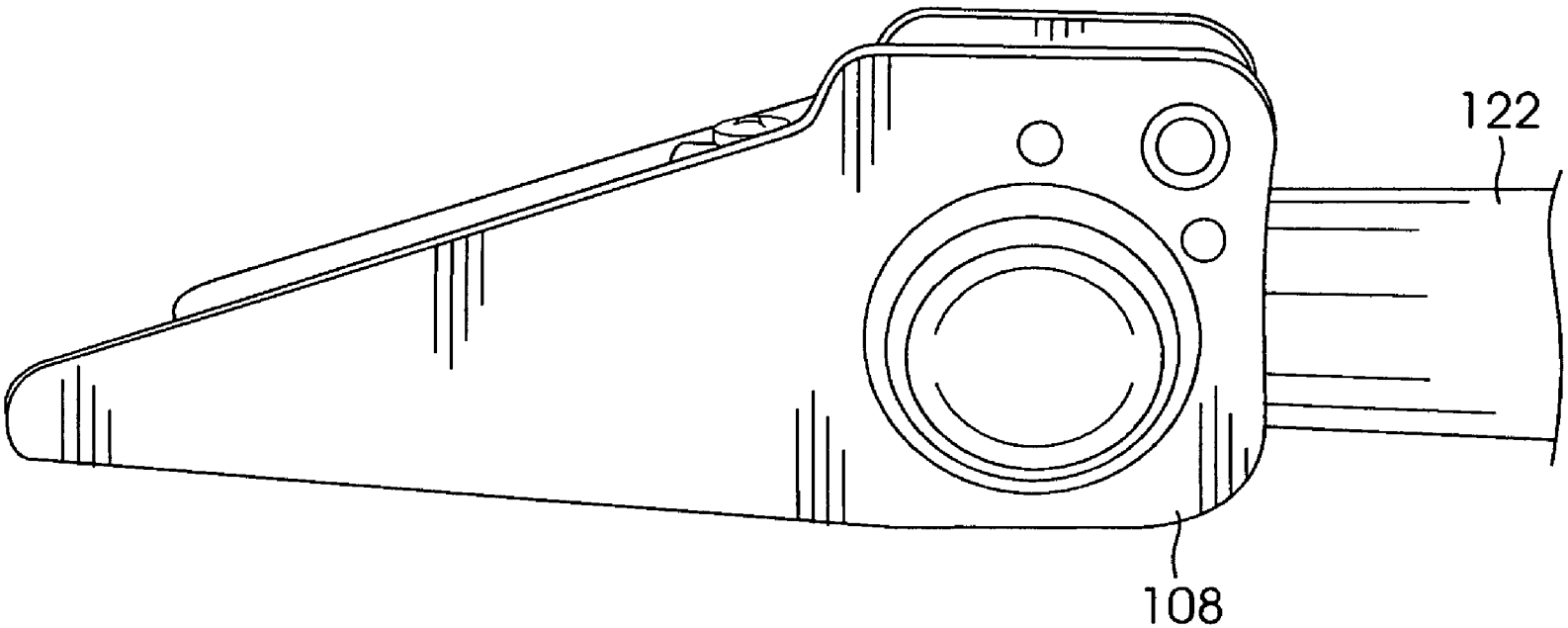
FIG. 12 is a side view of the same structure as in FIG. 11.

As shown in FIG. 11, in between each bracket 108, a cylindrical support 129 is welded to cross member 124. Each support 129 supports one parallel tube 122. The tubes 122 slide through supports 129 freely until being stopped by screws 130 in the intermediate position (see FIG. 10A) or on the other end by the first rung 113 in the storage position (see FIG. 9).

Figure 3:
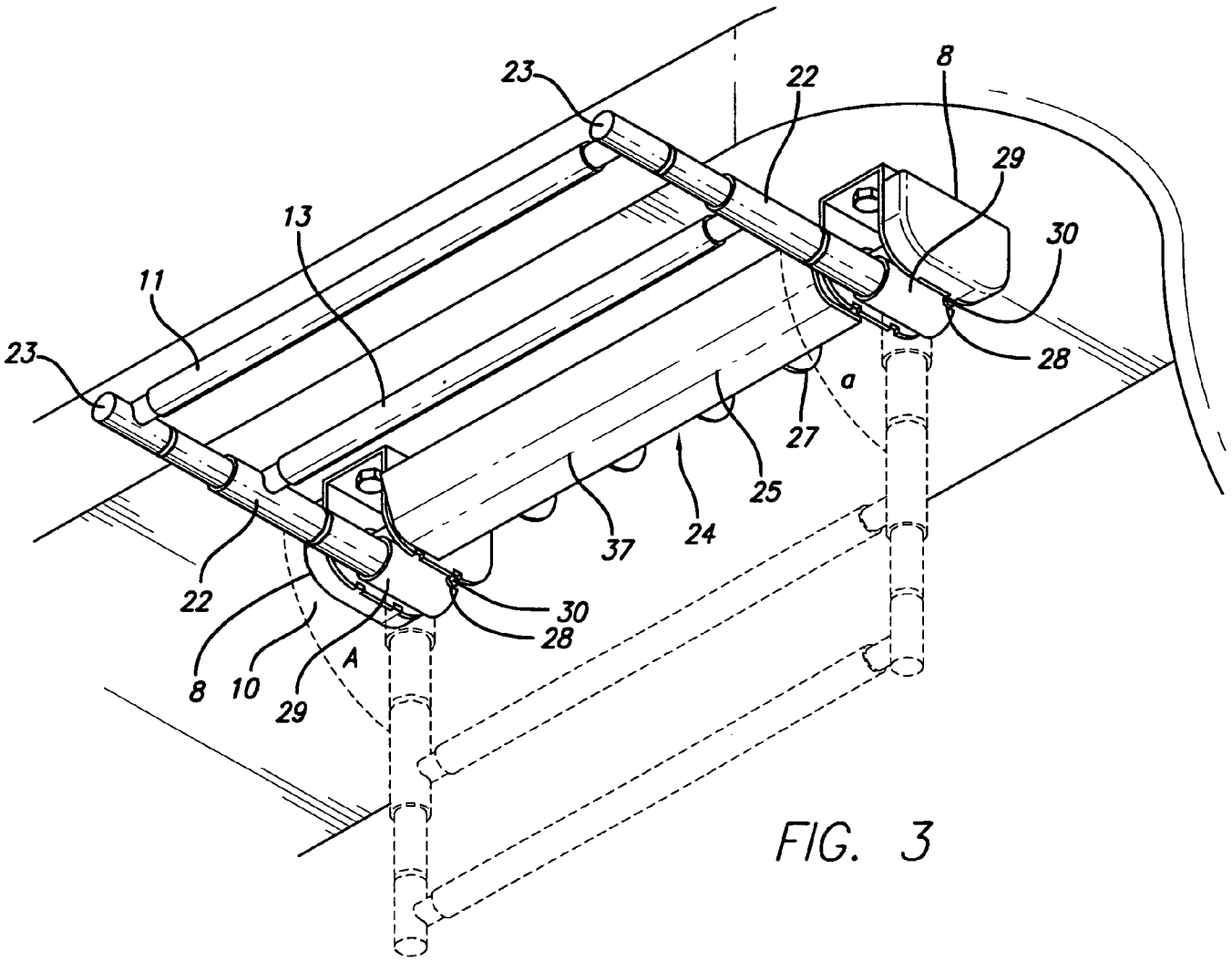
FIG. 3 is a view similar to FIG. 2 showing the ladder in an extended and intermediate position in solid lines and in an in-use position in phantom.

With continued reference to FIGS. 9, 10A and 10B the operation of the ladder assembly is the same as described above for the first embodiment in connection with FIGS. 2 and 3.

In this second embodiment, there is also a locking assembly to lock the ladder into the use position until actuated by the user. Such locking assembly is best shown in FIGS. 10A and 10B, and operates the same as the locking assembly 37 of FIG. 8.

Shown in FIG. 10B, welded to the cross member 124 are washers 127 or rings. Preferably, there are four evenly spaced washers 127. Also extending in between each bracket is a plate 125 (a cover plate or lever), which operates the same as bent plate 25 of the first embodiment. Because cross member 124 is fixed to supports 129 and thus is fixed to ladder 109, cross member 124 is rotated by the torsion springs 132 in the same direction as the ladder 109, which is biased into the storage position.

Each washer 127 (227 in FIG. 17, the plastic version of rod 224 and washers 227, unitarily formed) has a notch just like notch 31 (231 in the plastic version) in each washer 27 of the first embodiment, which notch serves to catch one end 125*a* of cover plate 125. The difference in this second embodiment in the cover plate 125 versus the bent plate 25 is that the cover plate 125 is generally U-shaped in section (as shown in FIGS. 9-10B), which helps keep the edges of the cover plate out of the way of the user, and may also be more aesthetically pleasing, e.g., by covering the springs.

Figure 14:
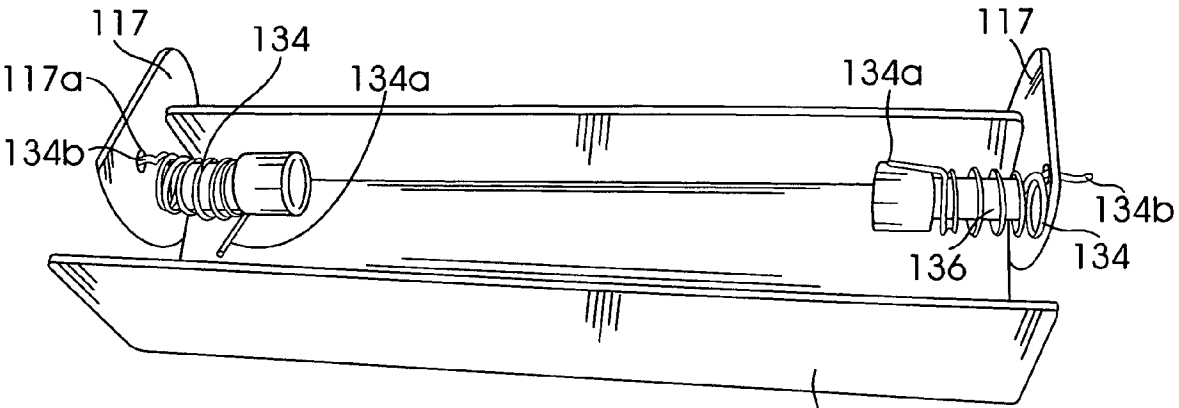
FIG. 14 is a bottom perspective view of a cover plate and other elements in the structure of FIG. 13, showing small spring positions in the second embodiment.

Cover plate 125 is fixed, e.g., by welding, to two cylindrical sleeves 136 (FIG. 14) which fit over bolts 137 (or screws or pins that extend through the bracket) as shown in FIG. 9. This allows cover plate 125 (225 in the plastic version) to rotate about its axis formed by rods 136 fitted over bolts 137 or sleeves 238 fitted over bolts 137 (best shown in FIG. 15).

There is also a torsion spring 132 which biases cover plate 125 in a counterclockwise direction.

Also as in the second embodiment, there is a pair of torsion springs which bias cover plate 125 in a counterclockwise direction (shown by arrow C of FIG. 4A for the first embodiment). One end 134*a* of each spring 134 is fixed, e.g., welded or merely presses on cover plate 125 or fixed to sleeve 136, and the other end 134*b* fits into a side wall 117*a* of bracket 108. The bias of the springs 134 causes the bottom 125*a* of cover plate 125 to press against the washers 127 locking rod 124 from rotating, thereby locking the ladder from rotating. The locking and unlocking of the ladder are performed in the same manner as in the first embodiment. Preferably, these springs 134 are relatively small compared to springs 132.

Figure 15:
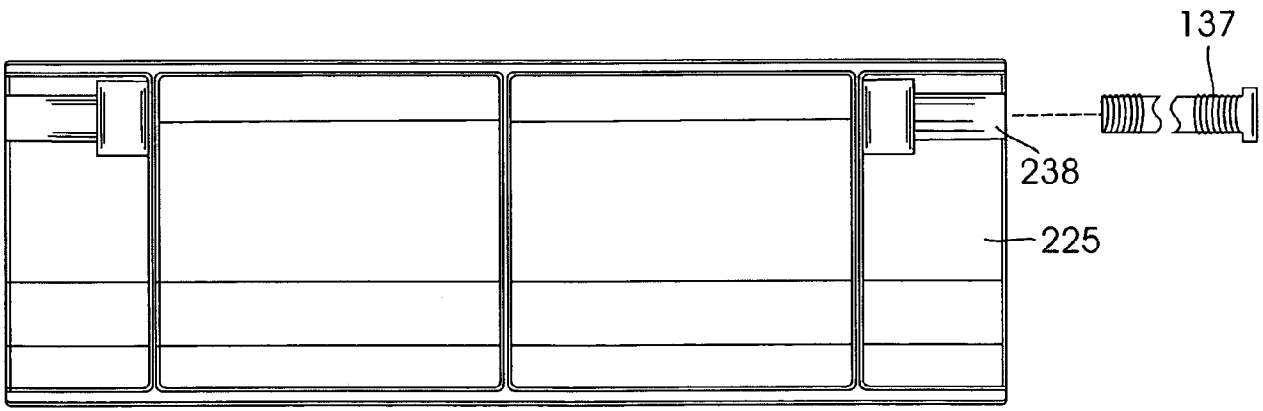
FIG. 15 is a view similar to FIG. 14 but of a variation of the second embodiment where the cover plate is made of plastic.
Figure 16:
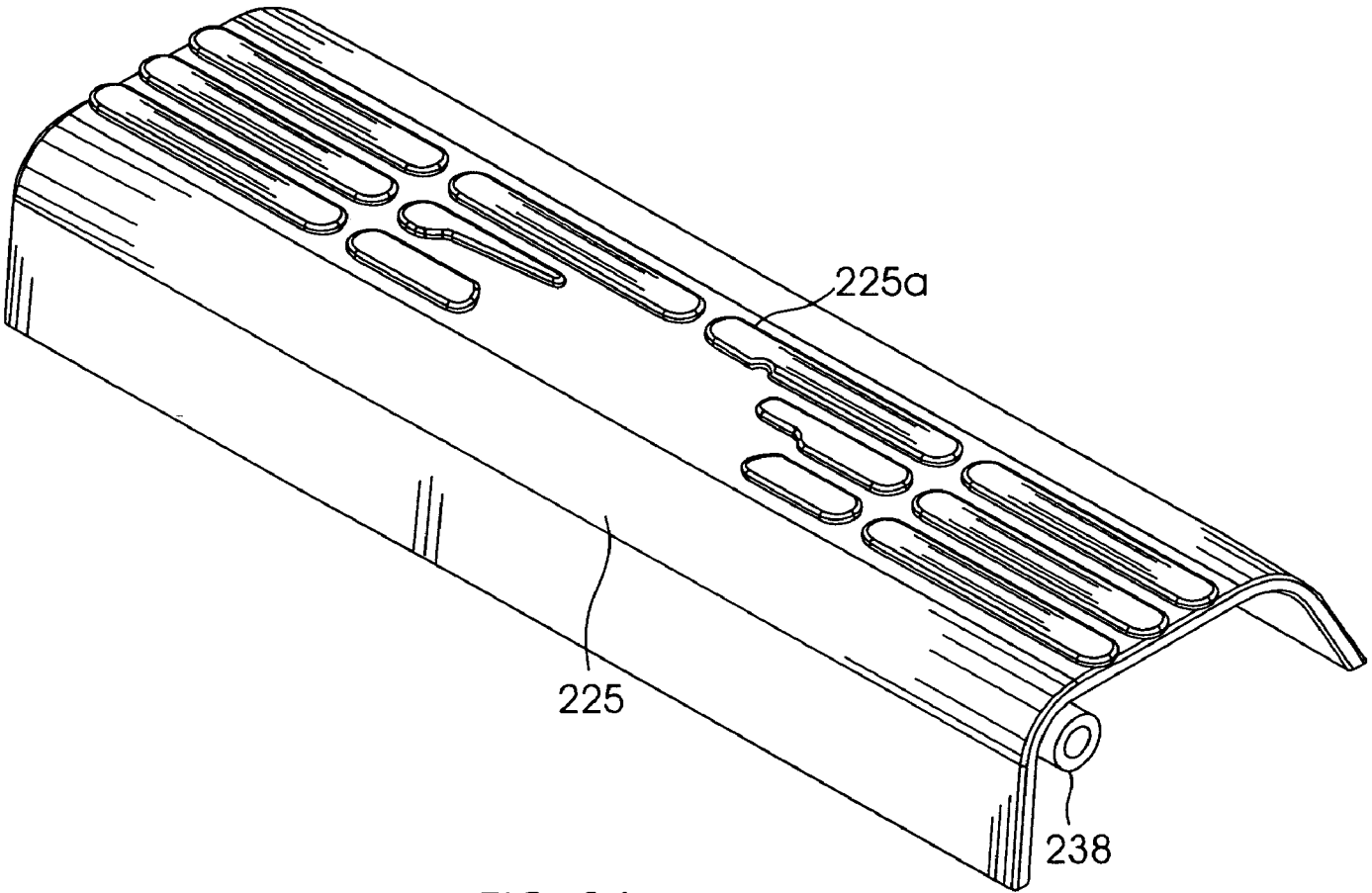
FIG. 16 is a top perspective view of the cover plate or bent plate of the locking mechanism of FIG. 9 when made of plastic.

In the variation of the second embodiment, cover plate 225 is made of plastic. The top of the cover plate has bumps or serrations or grooves. FIG. 15 shows the cover plate 225 from the underside. FIG. 16 shows the cover plate 225 from the outside. There may be bumps or the like in the other embodiments too.

Figure 17:
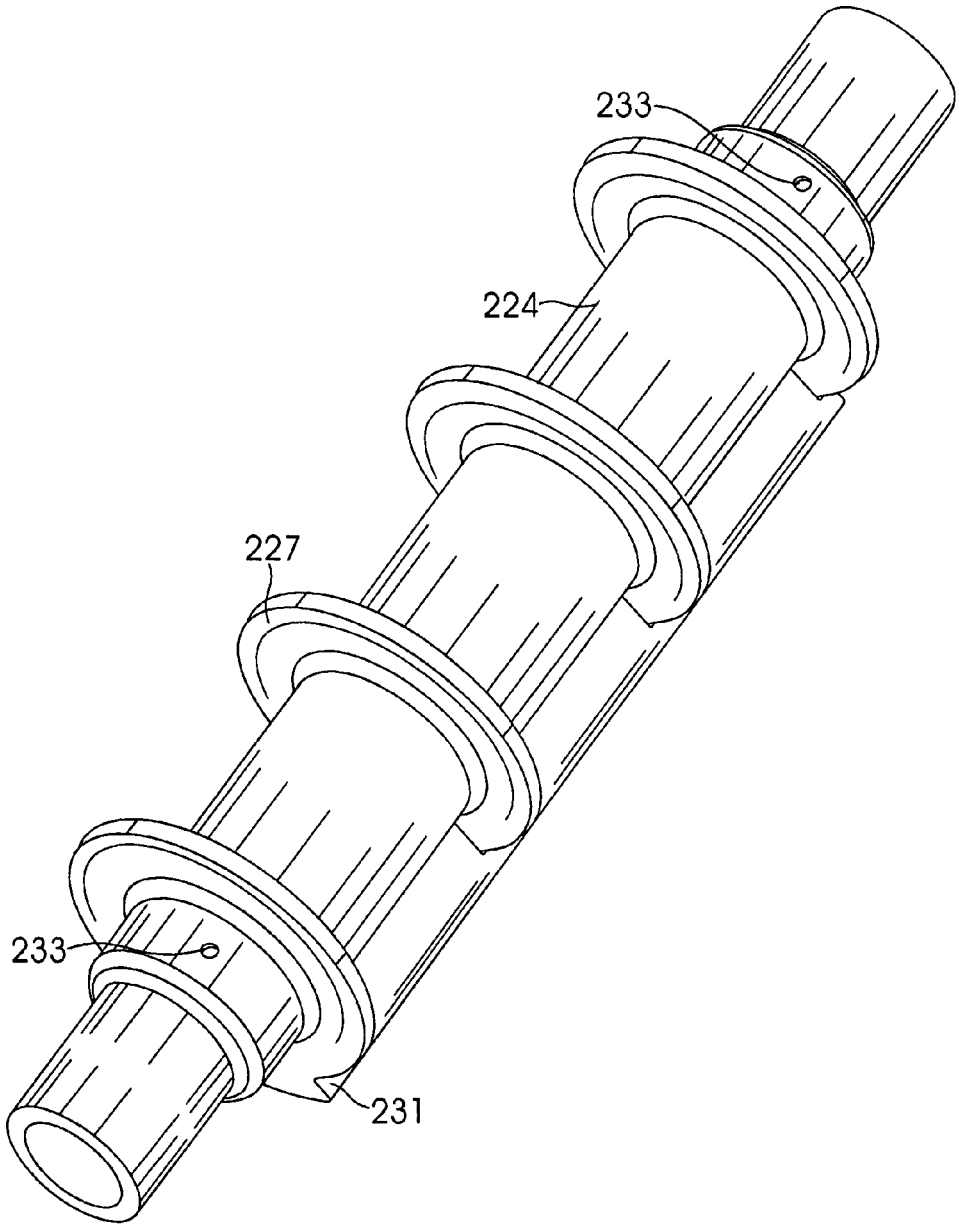
FIG. 17 is a perspective view of the rod or cross member of FIG. 13 when made of plastic in accordance with a variation of the second embodiment.

FIG. 17 shows rod 224 having rings 227, where the rod is made of plastic and the rings 227 are unitarily molded with the rod. Also in this plastic version or any other version, one end of springs 132 (the large springs) can fit into a slot 233 in the rod, or a screw or the like may be used to hold the end as in the other embodiments.

Although the invention has been described using specific terms, devices, and/or methods, such description is for illustrative purposes of the preferred embodiment(s) only. Changes may be made to the preferred embodiment(s) by those of ordinary skill in the art without departing from the scope of the present invention, which is set forth in the following claims. In addition, it should be understood that aspects of the preferred embodiment(s) generally may be interchanged in whole or in part. For example, the surface that the brackets are mounted upon may be a slidable platform or slidable members, such as well known in the art.

What is claimed is:

1. A step assembly for a craft, the step assembly comprising:

a U-shaped base step having two elongate sides and a rung extending therebetween; and two mounting elements for pivotally supporting the base step proximate each of the ends of the sides, each mounting element comprising means for fixing the element to a craft for providing a pivot axis for enabling rotation of the base step between a first position where the base step extends substantially downward for use by a person trying to embark on or disembark from the craft, and a second position where the base step is rotationally retracted with respect to the first position, and means for biasing the base step to rotationally retract by rotating from the first position to the second position, wherein the base step has a locking mechanism for locking the base step into the first position against the means for biasing, the locking mechanism including a rod extending from each bracket and rotatable with respect thereto, the base step being fixed with respect to the rod for rotating with the rod, and the rod having a cam surface thereon, the locking mechanism also comprising a cover member, the cover member having biasing means for biasing the cover member in an opposite rotational direction as the ladder, the cover member being adapted for engaging the cam surface in the locked position to hold the rod from rotating, and the cover member being manually movable in the same rotational direction of the step and rod to release the locking mechanism in response to pressing on the cover member to move the cover member in the same rotational direction as the bias of the step, wherein the means for biasing comprises a spring mounted around the rod.

2. The step assembly of claim 1, wherein the spring comprises a torsion spring, and wherein one end of the spring is attached to one of the mounting elements and another end is attached to the rod.

3. The step assembly of claim 1, wherein the rod has rings fixed there around, and the cam surface is formed in the circumference of the rings, and wherein the rod and rings are unitarily formed of plastic.

4. The step assembly of claim 3, wherein the cam surface comprises a notch in each ring, and wherein the cover member comprises a U-shaped cross-section and is of plastic.

5. The step assembly of claim 3, wherein each of the rings is disposed between the brackets.

6. The step assembly of claim 1, wherein the cover member is pivotably mounted with respect to the mounting elements, and the cover member disengages from the cam surface in response to manually pivoting the cover member.

7. The step assembly of claim 1, wherein the cover member is pressed against the rings, and wherein the rod and rings are unitarily formed of plastic.

8. The step assembly of claim 4, wherein the cover member fits into the notch of each ring when the ladder is in the first position, and wherein the cover member comprises a U-shaped cross section and is of plastic.

9. The step assembly of claim 1, wherein the cover member is pressed against the rings, and wherein the rod and rings are unitarily formed of plastic.

10. The step assembly of claim 1, wherein the mounting elements comprise brackets, and each spring is located proximate and between the brackets.

11. The step assembly of claim 4, wherein the cover member has a bend and fits into the notch of each ring when the ladder is in the first position, and wherein the cover member comprises a U-shaped cross section and it of plastic.

12. A step assembly for a craft, the step assembly comprising:

U-shaped base step having two elongate sides and a rung extending therebetween, and two mounting elements for pivotally supporting the base step proximate each of the ends of the sides, each mounting element comprising means for fixing the mounting element to a craft for providing a pivot axis for enabling rotation of the base between a first position where the base step extends substantially downward for use by a person trying to embark on or disembark from the craft, and a second position where the step is rotationally retracted with respect to the first position, and means for biasing the base step to rotationally retract by rotating from the first position to the second position, wherein the step has a locking mechanism for locking the step into the first position against the means for biasing, the locking mechanism including an elongate member extending from each mounting element and rotatable with respect thereto, and the base step being rotatable with the elongate member, and the elongate member having a cam surface therein, the locking mechanism also comprising a cover member, the cover member having biasing means for biasing the cover member in an opposite rotational direction as the ladder, and for engaging the cam surface to physically hold the elongate member from rotating and thereby lock the rotation of the ladder, and the cover member being manually movable in the same rotational direction of the step and elongate member to release the locking mechanism in response to pressing on the cover member to move the plate in the same rotational direction as the bias of the step, wherein the means for biasing comprises a spring mounted around the rod.

13. The step assembly of claim 12, wherein the biasing means for the cover member comprises torsion springs.

14. The step assembly of claim 13, wherein there are means connected to the mounting elements and means connected to the cover member for forming a pivot axis for the cover member to rotate in a teeter-totter fashion.

15. The step assembly of claim 12, wherein biasing means for biasing further comprises a torsion spring, and wherein one end of the spring is attached to the mounting element and another end is attached to the rod.

16. The step assembly of claim 12, wherein biasing means for biasing further comprises a torsion spring, and wherein one end of the spring is attached to the mounting means and another end is attached to the rod.

17. A step assembly for a craft, the step assembly comprising:

U-shaped base step having two elongate sides and a rung extending therebetween, and two mounting elements for pivotally supporting the base step proximate each of the ends of the sides, each mounting element comprising means for fixing the element to a craft for providing a pivot axis for enabling rotating of the base between a first position where the base step extends substantially downward for use by a person trying to embark on or disembark from the craft, and a second position where the step is rotationally retracted with respect to the first position, and means for biasing the base step to rotationally retract by rotating from the first position to the second position, wherein the step has a locking mechanism for locking the step into the first position against the means for biasing, the locking mechanism including an elongate member extending from each bracket for moving the base step, and the elongate member having a cam surface therein, the locking mechanism also comprising a cover member, the cover member having biasing means for biasing the cover member in an opposite rotational direction as the ladder, so that when the ladder is in a first position one end of the cover member is biased radially inward with respect to the cam surface, and the cam surface having means for engaging the one end of the cover member to thereby lock the elongate member and thereby lock the ladder against rotation from the first use position to the second retracted position when the cover member is in a locking position, and when the cover member is in an unlocking position with the one end of the cover member disengaged from the means for engaging, the elongate member may freely rotate so that the ladder may freely rotate from the use position to the retracted position, and the cover member being manually movable in the same rotational direction of the step and elongate member to release the locking mechanism in response to pressing on the cover member to move the cover member in the same rotational direction as the bias of the step, wherein the means for biasing comprises a spring mounted around the rod.

18. The step assembly of claim 17, wherein the means for engaging comprises notches.

19. The step assembly of claim 17, wherein means for engaging comprises notches, and the one end of the cover member is engaged with the notches when the cover member is in the locking position.

20. The step assembly of claim 17, wherein the cover member disengages from the means for engaging in response to manually rotating the cover member against the bias of the spring.

* * * * *